US008122540B2

(12) United States Patent
Ardis

(10) Patent No.: US 8,122,540 B2
(45) Date of Patent: Feb. 28, 2012

(54) BED HEADBOARD WITH VENTILATION SYSTEM

(75) Inventor: Stephen Ardis, Orange, CA (US)

(73) Assignee: Furniture Traditions, Inc., Orange, CA (US)

( * ) Notice: Subject to any disclaimer, the term of this patent is extended or adjusted under 35 U.S.C. 154(b) by 0 days.

(21) Appl. No.: 12/777,188

(22) Filed: May 10, 2010

(65) Prior Publication Data

US 2011/0271449 A1 Nov. 10, 2011

(51) Int. Cl.
*A47C 27/00* (2006.01)

(52) U.S. Cl. ..... 5/423; 5/421; 5/284; 55/385.1

(58) Field of Classification Search ..... 5/421, 423, 5/53.1; 454/187, 186, 56, 254; 62/186; 55/385.1
See application file for complete search history.

(56) References Cited

U.S. PATENT DOCUMENTS

| | | | | | |
|---|---|---|---|---|---|
| 2,186,142 | A | * | 1/1940 | Lieberman | 5/53.1 |
| 2,463,090 | A | * | 3/1949 | Dixon et al. | 62/261 |
| 3,151,929 | A | * | 10/1964 | Potapenko | 5/423 |
| 3,230,556 | A | * | 1/1966 | Shippee | 5/423 |
| 3,724,172 | A | * | 4/1973 | Wood | 5/423 |
| 3,928,876 | A | * | 12/1975 | Starr | 5/726 |
| 3,935,803 | A | * | 2/1976 | Bush | 454/189 |
| 4,094,232 | A | * | 6/1978 | Howorth | 454/187 |
| 4,140,105 | A | * | 2/1979 | Duvlis | 454/191 |
| 4,602,486 | A | * | 7/1986 | Weinstein | 62/261 |
| D292,456 | S | * | 10/1987 | Wycoff | 5/414 |
| 4,937,903 | A | * | 7/1990 | Joly et al. | 5/423 |
| 5,389,037 | A | * | 2/1995 | Hale | 454/284 |
| 5,832,919 | A | * | 11/1998 | Kano et al. | 128/205.26 |
| 6,099,607 | A | * | 8/2000 | Haslebacher | 55/356 |
| 6,119,689 | A | * | 9/2000 | Korman | 128/205.29 |
| 6,261,332 | B1 | * | 7/2001 | Richard | 55/385.1 |
| 7,037,188 | B2 | * | 5/2006 | Schmid et al. | 454/187 |
| 7,195,660 | B2 | * | 3/2007 | Little et al. | 454/187 |
| 7,361,082 | B2 | * | 4/2008 | Nilsson | 454/187 |
| 7,487,646 | B2 | * | 2/2009 | Matsushima et al. | 62/186 |
| 7,543,583 | B2 | * | 6/2009 | Acton | 5/423 |
| 7,753,977 | B2 | * | 7/2010 | Lyons et al. | 55/385.1 |
| 2003/0033790 | A1 | * | 2/2003 | Hague | 55/385.1 |
| 2010/0005588 | A1 | * | 1/2010 | Christopher | 5/423 |
| 2010/0125949 | A1 | * | 5/2010 | Stebbing | 5/423 |
| 2010/0205739 | A1 | * | 8/2010 | Gallant et al. | 5/600 |

FOREIGN PATENT DOCUMENTS

FR 2594668 A1 * 8/1987

OTHER PUBLICATIONS

Furniture Traditions Catalog, Summer 1989.
Furniture Traditions, Catalog, 1998.
Furniture Traditions, Catalog.

* cited by examiner

*Primary Examiner* — Robert G Santos
*Assistant Examiner* — Brittany Wilson
(74) *Attorney, Agent, or Firm* — Stetina Brunda Garred & Brucker

(57) ABSTRACT

A bed headboard is provided having output ports for directing individually adjustable airflows towards different areas of the headboard. A headboard comprises a headboard upper portion and an overhang disposed proximate the headboard upper portion. The overhang further includes a bottom surface and a pair of side surfaces, defining an overhang compartment. A blower is provided in the overhang compartment. A plurality of output ports are provided in fluid communication with the blower and extending through the overhang bottom surface. The output ports may be adjustable to regulate the direction of airflow therefrom and/or volume of airflow therethrough.

22 Claims, 3 Drawing Sheets

BED HEADBOARD WITH VENTILATION SYSTEM

CROSS-REFERENCE TO RELATED APPLICATIONS

Not Applicable

STATEMENT RE: FEDERALLY SPONSORED RESEARCH/DEVELOPMENT

Not Applicable

BACKGROUND

The present invention is directed to bed headboards and, more particularly, to bed headboards having individually adjustable ventilation ports.

Traditional beds are constructed of a mattress, box spring and frame. Headboards commonly add desirable design appeal to the beds, and in some cases can include additional features, such as storage areas, lighting systems, and electrical outlets.

Mattresses are available in a variety of styles and firmness levels. More recently, mattresses have been marketed with active systems for adjusting the firmness level of mattress portions, allowing one person to sleep on a section that is adjusted to be firmer or softer than another portion. This trends towards allowing individual adjustment to the preferences of individuals includes the provision of individual lighting systems on headboards. As such, when the couple sleep on the bed, one person can read or sleep on a mattress having a firmer support, while the other person sleeps on a softer support section without any light directed upon that person.

One area which contemporary bedding systems do not allow for individual adjustment concerns the ventilation or breeze felt by the individual users. Conventionally, one person may find it more comfortable to sleep with more of a breeze, whereas another person may be uncomfortable with the same level of breeze. As such, individuals may be forced to make uncomfortable compromises regarding how far open a window is kept, or how fast an overhead fan is operated. As with many such compromises, neither person may be very satisfied or comfortable with the results.

The present invention is directed towards a bed headboard that addresses these issues, to allow for individuals sleeping in the same bed to have different levels of breezes directed towards them. As described more below, the invention allows individuals to regulate functions such as the volume of breeze directed towards them, the direction of the breeze directed towards them, and allows for the complete exclusion of any breeze directed towards them. The present invention is, therefore, intended to allow each person to enhance the level of their sleep comfort, without detracting from the comfort of the other.

BRIEF SUMMARY

A bed headboard is provided having output ports for directing individually adjustable airflows towards different areas of the headboard. A headboard comprises a headboard upper portion and an overhang disposed proximate the headboard upper portion. The overhang further includes a bottom surface and a pair of side surfaces, defining an overhang compartment. A blower is provided in the overhang compartment. A plurality of output ports are provided in fluid communication with the blower and extending through the overhang bottom surface. The output ports may be adjustable to regulate the direction of airflow therefrom and/or volume of airflow therethrough.

In the presently preferred embodiment the output ports are adjustable to regulate both the direction of airflow from the output ports and the volume of airflow through the output ports. As such, individuals lying on different areas of the bed may have cooling air directed towards them, at such a volume and at such a location as suits each individual. Each output port may be completely shut so that no airflow is directed to one individual. At the same time, the other individual can have airflow directed at such a volume and location as that individual deems most comfortable.

In addition to regulating airflow by adjusting the output ports, the blower may be implemented as a multi-speed blower which may be regulated by adjustment of the blower switch that is preferably disposed in the overhang lower surface.

In one embodiment the blower may be implemented as a blower/heater, to allow cool air or warm air to be directed at individuals on the bed as desired. The invention also contemplates the use of multiple blowers arrayed within the overhang compartment, such that each individual can operate a dedicated blower/heater. This allows one individual to have cooling, or unheated air directed at that individual, while another individual directs heated air to the selected area of the bed.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

The above description is given by way of example, and not limitation. Given the above disclosure, one skilled in the art could devise variations that are within the scope and spirit of the invention disclosed herein, including various ways of constructing and arranging the vents and blower described herein. Further, the various features of the embodiments disclosed herein can be used alone, or in varying combinations with each other and are not intended to be limited to the specific combination described herein. Thus, the scope of the claims is not to be limited by the illustrated embodiments.

Figure 1:
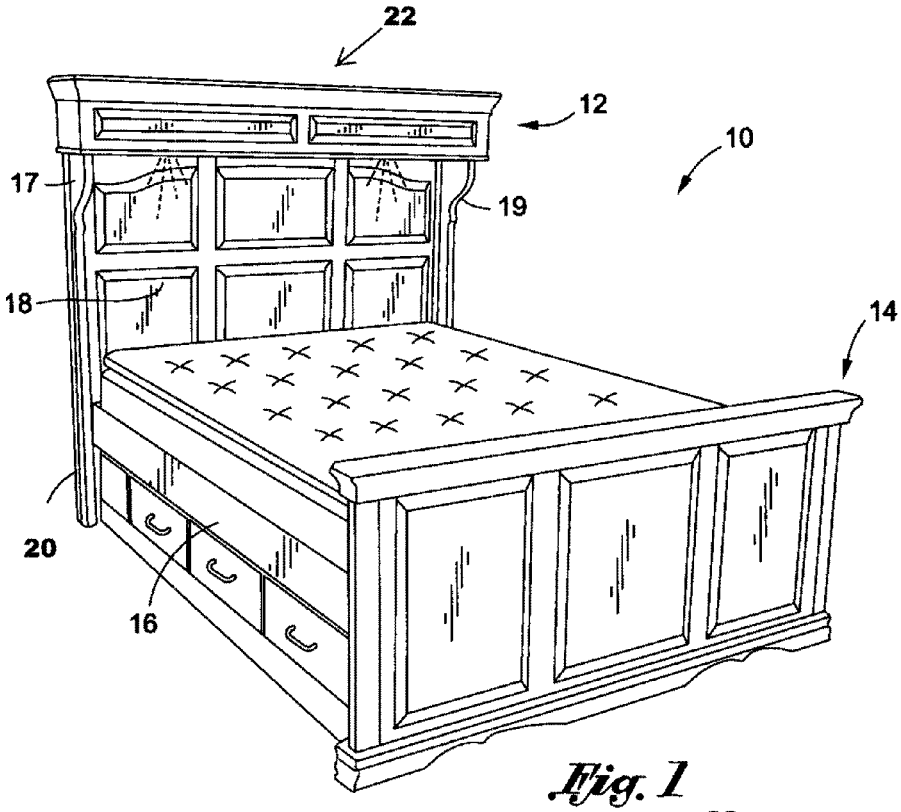
FIG. 1 is a front perspective view of a bed having a headboard made in accordance with the present invention.
Figure 2:
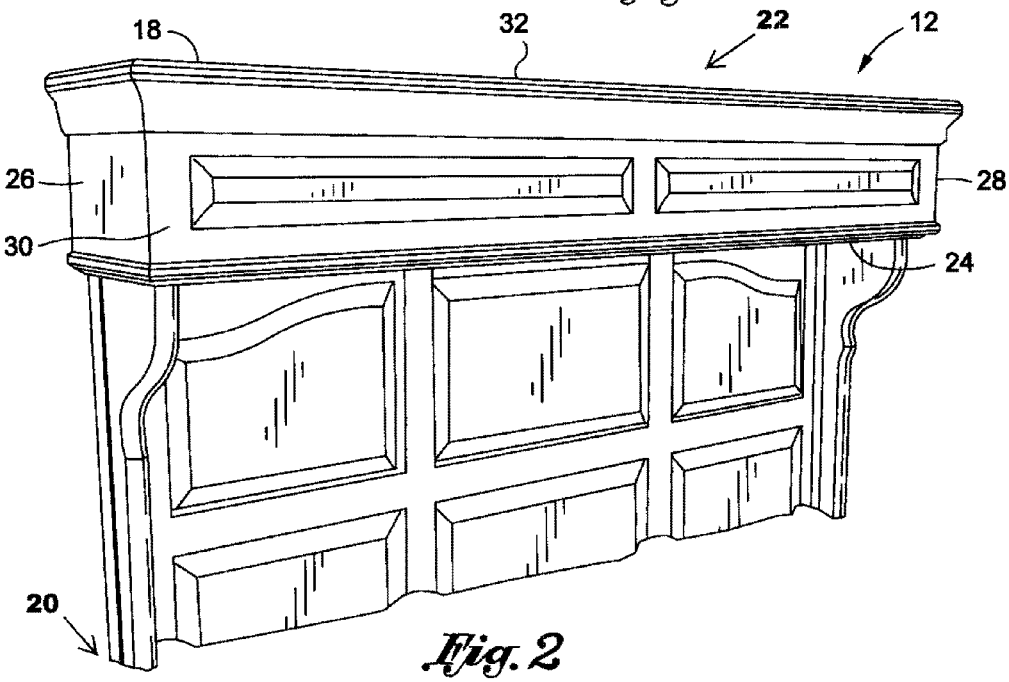
FIG. 2 is an enlarged view of the headboard shown at FIG. 1.

Referencing FIGS. 1 and 2 of the drawings, and exemplary bed 10 is illustrated which includes headboard 12, footboard 14 and side rails 16. The headboard 12, shown in more detail at FIGS. 2, 5 and 6, includes a headboard panel 18 and headboard bottom portion or legs 20 and sideboards 17, 19.

Overhang 22 is connected to the headboard proximate headboard panel 18. The overhang 22 includes a bottom surface 24, side portions 26, 28 and front portion 30. The bottom surface 24, side portions 26, 28 and front portion 30 define a compartment 34. The overhang 22 may also include a top surface 32, enclosing an interior compartment 34.

Figure 3:
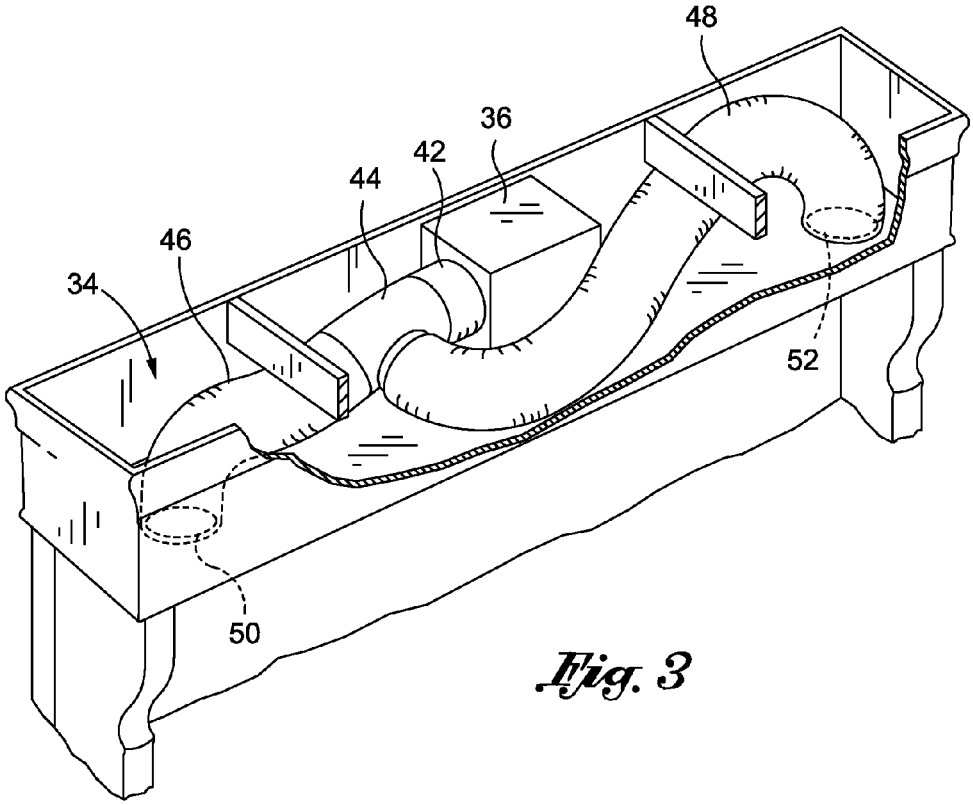
FIG. 3 is a rear view of a blower unit mounted in the headboard overhang portion.
Figure 4:
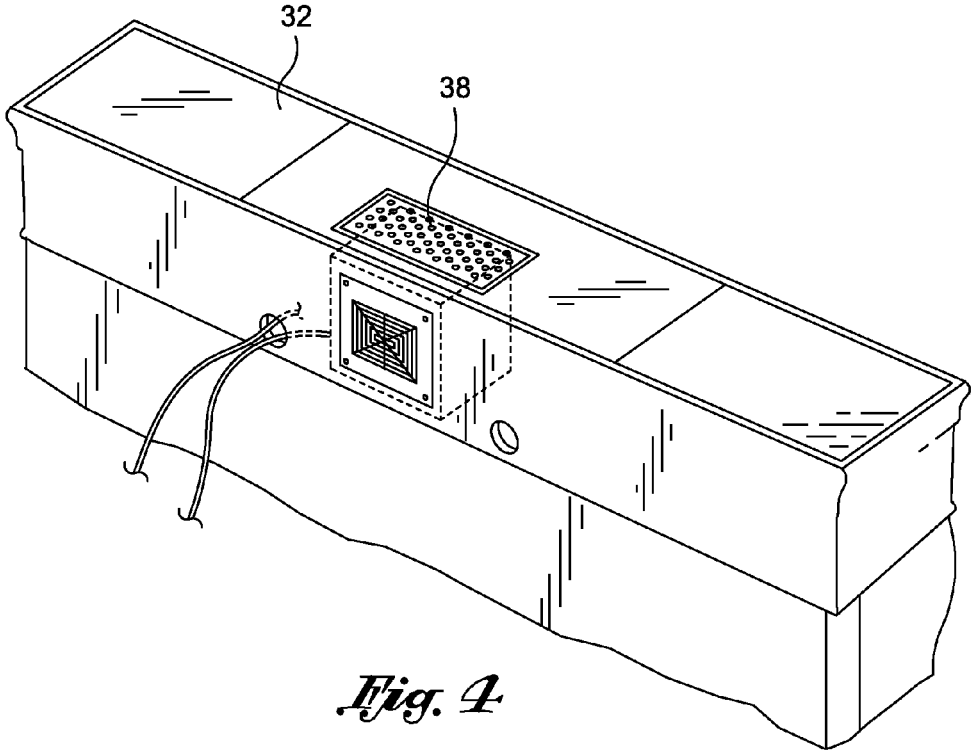
FIG. 4 is a top view of the headboard portion, with the upper surface removed.

As shown at FIGS. 3 and 4, a blower 36 is disposed within the compartment 34. Where the compartment 34 includes top surface 32, an input vent 38 is provided to facilitate the flow of air into the blower 36.

As shown at FIG. 3, a blower output duct 42 is in fluid communication with the blower to communicate air outward from the blower 36. The blower output duct 42 is engaged to output duct joint 44, which is in communication with vent ducts 46, 48. The vent ducts 46, 48 are in communication with vent apertures 50, 52, respectively.

Figure 5:
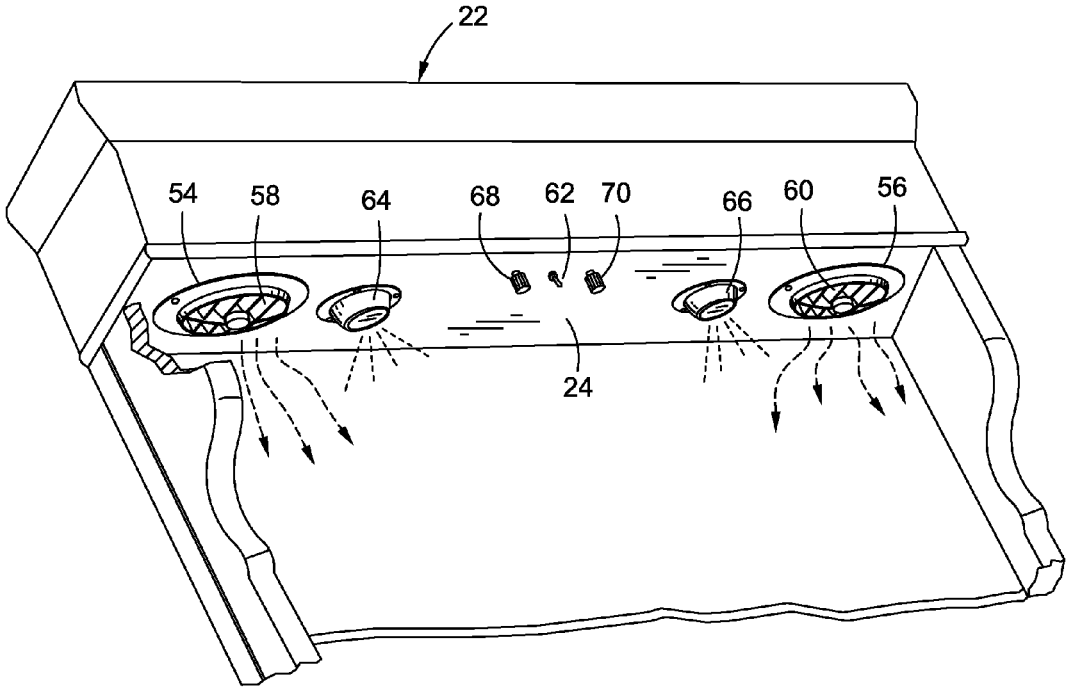
FIG. 5 is a bottom perspective view of the overhang portion.
Figure 6:
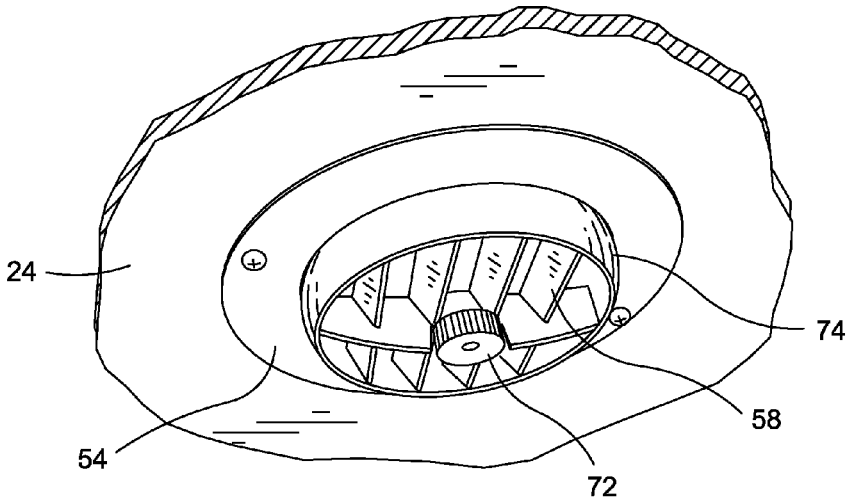
FIG. 6 is an enlarged view of a vent port mounted in the overhang portion.

As shown in FIGS. 5 and 6, the vent ducts 46, 48 extend through the bottom surface 24 of overhang 22. The vent ducts are engaged to rotatable vents or output ports 54, 56, output ports 54, 56 are provided with adjustable vanes, 58, 60.

The rotatable output ports 54, 56 are positioned adjustable to regulate the direction of airflow from the output ports. Each of the output ports 54, 56 is individually adjustable so that each person sleeping on the bed 10 adjust the direction of output airflow as individually desired. The rotatable output ports 54, 56 are preferably constructed to have a ball and socket configuration, so that yolk portion 74 may be rotated relative to aperture 76, to allow the output airflow to be directed as desired. The adjustable vanes 58, 60, are also individually adjustable, e.g. by rotation of knob 72, so that each individual can regulate the volume of airflow through the output ports, and allows each individual to close the output port, if desired.

Blower switch 62 is in electrical communication with the blower 36, and operates to activate the blower 36. Where the blower 36 is implemented as a multi-speed blower, the blower switch 62 may be implemented as a multi-position switch, e.g. three or four positions, that operates to allow selection of the blower speed, in addition to turning the blower on and off. Blower 36 may also be implemented as a blower/heater that outputs heated or unheated air in response to operation of switch 62. In another embodiment, multiple blowers may be provided, each connected to a dedicated blower vent. In such an embodiment each blower 36 may be individually operated so that one blower may output heated air and another blower may output unheated air.

As shown at FIG. 5, the overhang 22 may also include lights 64, 66, which are regulatable by light switches 68, 70, respectively. As with the vents 50, 52, the lights 64, 66 are adjustable in direction, as desired by persons sleeping on the bed 10. Moreover, the light switches 68, 70 may also be implemented as multi-level switches, allowing adjustment of the intensity of lights 64, 66, as well as turning the lights 64, 66 on and off.

As will be apparent to those of ordinary skill in the art, the drawings and accompanying description are illustrative of one embodiment of the invention, which may be implemented in alternative embodiments that are within the broader spirit and scope of the invention. The constructions of the output ports, blower and other features of the invention are exemplary, and different types of vents and vent systems may be implemented within the scope of the present invention.

What is claimed is:

1. A bed headboard having vent ports for directing individually adjustable air flows towards different areas of the bed, the headboard comprising:

a headboard;

an overhang connected to and extending from the headboard, the overhang including a bottom surface and a plurality of sick surfaces, defining an overhang compartment, wherein the overhang is supported solely by the headboard;

a blower disposed in the overhang compartment; and a plurality of output ports extending through the overhang bottom surface, in fluid communication with the blower, the output ports being adjustable to regulate airflow therethrough.

2. The bed headboard as recited in claim 1 wherein the output ports are adjustable to regulate airflow volume therethrough.

3. The bed headboard as recited in claim 2 wherein the output ports are adjustable to regulate the direction of airflow therefrom.

4. The bed headboard as recited in claim 3 wherein the output ports are formed of a ball and socket construction.

5. The bed headboard as recited in claim 3 wherein each output port is separately adjustable to regulate the volume airflow therethrough.

6. The bed headboard as recited in claim 5 wherein each output port is separately adjustable to regulate the direction of airflow therefrom.

7. The bed headboard as recited in claim 6 further comprising a switch, extending through the overhang lower surface, for activating the blower.

8. The bed headboard as recited in claim 1 wherein the blower is formed as a blower/heater, for selectively outputting cool air or warm air through the output ports.

9. The bed headboard as recited in claim 1 wherein the further comprising ducting disposed in the overhang compartment for communicating air flow from the blower to the output ports.

10. The bed headboard as recited in claim 1 further comprising a plurality of lights extending through the overhang bottom surface, wherein each light is separately adjustable to regulate the direction of light therefrom.

11. The bed headboard as recited in claim 1 wherein the headboard further comprises a pair of side rails disposed on opposite sides of the headboard, the overhang extending from the headboard a distance approximately equal to the width of the side rails.

12. A bed headboard having vent ports for directing individually adjustable air flows towards different areas of the bed, the headboard comprising:

a headboard:

an overhang connected to and extending from the headboard, the overhang including a bottom surface and a plurality of side surfaces, defining an overhang compartment, wherein the overhang is supported solely by the headboard;

a blower disposed in the overhang compartment; and a plurality of output ports extending through the overhang bottom surface, in fluid communication with the blower.

13. The bed headboard as recited in claim 12 wherein the output ports are adjustable to regulate airflow volume therethrough.

14. The bed headboard as recited in claim 13 wherein the output ports are adjustable to regulate the direction of airflow therefrom.

15. The bed headboard as recited in claim 14 wherein the output ports are formed of a ball and socket construction.

16. The bed headboard as recited in claim 14 wherein each output port is separately adjustable to regulate the volume airflow therethrough.

17. The bed headboard as recited in claim 16 wherein each output port is separately adjustable to regulate the direction of airflow therefrom.

18. The bed headboard as recited in claim 17 further comprising a switch, extending through the overhang lower surface, for activating the blower.

19. The bed headboard as recited in claim 12 wherein the blower is formed as a blower/heater, for selectively outputting cool air or warm air through the output ports.

20. The bed headboard as recited in claim 12 wherein the further comprising ducting disposed in the overhang compartment for communicating air flow from the blower to the output ports.

21. The bed headboard as recited in claim 12 further comprising a plurality of lights extending through the overhang bottom surface, wherein each light is separately adjustable to regulate the direction of light therefrom.

22. The bed headboard as recited in claim 12 wherein the headboard further comprises a pair of side rails disposed on opposite sides of the headboard, the overhang extending from the headboard a distance approximately equal to the width of the side rails.

* * * * *